United States Patent [19]

Newsome

[11] Patent Number: 4,534,367

[45] Date of Patent: Aug. 13, 1985

[54] ROLL-YOUR-OWN CIGARETTE MAKER

[75] Inventor: Reginald W. Newsome, Richmond, Va.

[73] Assignee: Philip Morris Incorporated, New York, N.Y.

[21] Appl. No.: 496,353

[22] Filed: May 19, 1983

[51] Int. Cl.[3] ..... A24C 5/00; A24F 47/00

[52] U.S. Cl. ..... 131/75; 131/73

[58] Field of Search ..... 131/70, 75, 69, 73, 131/6, 200, 329

[56] References Cited

U.S. PATENT DOCUMENTS

| | | | |
|---|---|---|---|
| 562,213 | 6/1896 | Bruandet . | |
| 1,932,936 | 10/1933 | Linthicum | 131/75 |
| 2,425,888 | 8/1947 | Matteson et al. | 131/70 |
| 2,496,375 | 2/1950 | Carter | 131/75 |
| 2,854,010 | 9/1958 | Stamm | 131/329 |
| 3,006,348 | 10/1961 | Banning . | |
| 3,124,141 | 3/1964 | Seitter . | |
| 3,491,768 | 1/1970 | Paynter . | |
| 3,688,777 | 9/1972 | Kastner . | |
| 3,693,630 | 9/1972 | Kastner . | |
| 3,699,975 | 10/1975 | Saraber . | |
| 3,721,247 | 3/1973 | Paynter . | |
| 3,721,248 | 3/1973 | Paynter . | |
| 3,741,220 | 6/1973 | Meinunger . | |
| 3,783,882 | 1/1974 | Messner et al. . | |
| 3,903,902 | 9/1975 | Messner et al. . | |
| 3,911,933 | 10/1975 | Crisp et al. . | |
| 4,005,716 | 2/1977 | Messner et al. . | |
| 4,040,429 | 8/1977 | Lacroix . | |
| 4,167,948 | 9/1979 | Moscowitch . | |
| 4,180,082 | 12/1979 | Wachter . | |
| 4,303,082 | 12/1981 | Thompson et al. . | |

FOREIGN PATENT DOCUMENTS

| | | | |
|---|---|---|---|
| 2709825 | of 0000 | Fed. Rep. of Germany . | |
| 384663 | 4/1908 | France . | |
| 397673 | 5/1909 | France . | |
| 407972 | 3/1910 | France . | |
| 427582 | 8/1911 | France . | |
| 135554 | of 1919 | United Kingdom . | |
| 188237 | 11/1922 | United Kingdom . | |
| 549438 | 12/1942 | United Kingdom | 131/75 |
| 717417 | 10/1954 | United Kingdom . | |

*Primary Examiner*—V. Millin

*Attorney, Agent, or Firm*—Jeffrey H. Ingerman

[57] ABSTRACT

A pocket-sized roll-your-own cigarette maker is disclosed. The cigarette maker includes one or more elements defining a tobacco chamber to receive a charge of tobacco to be made into a single cigarette, and a mandrel which serves as a form for making a cigarette wrapper into a paper tube to receive the tobacco charge. The mandrel includes a tamping device for tamping the charge of tobacco into the proper shape and into place in the paper tube. A tongue member may be provided on the tamping device to aid in moving the tobacco charge into the tube. A stop element may also be provided to hold the paper tube in place adjacent the tobacco chamber to receive the charge of tobacco.

19 Claims, 48 Drawing Figures

10
12
14
16
24
26
28
30
32
34
36
40
42
44
46
48
4

70
72
74
75
80
82
84
88
96
98
100
102

Fig. 21.
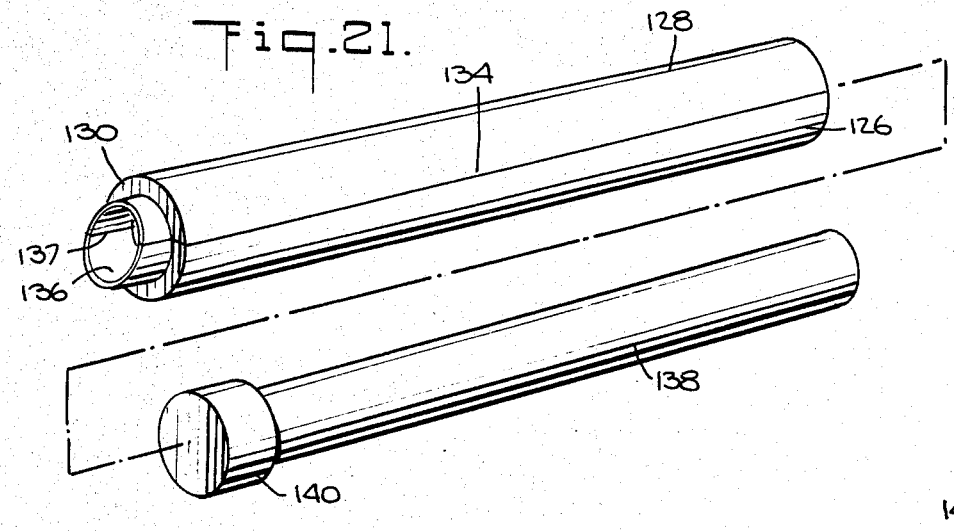
Fig. 22.
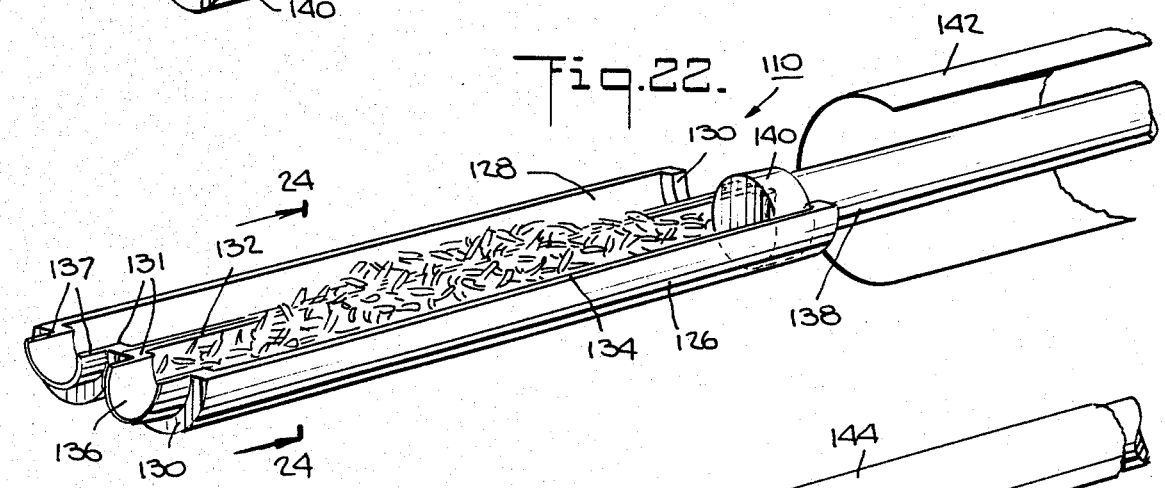
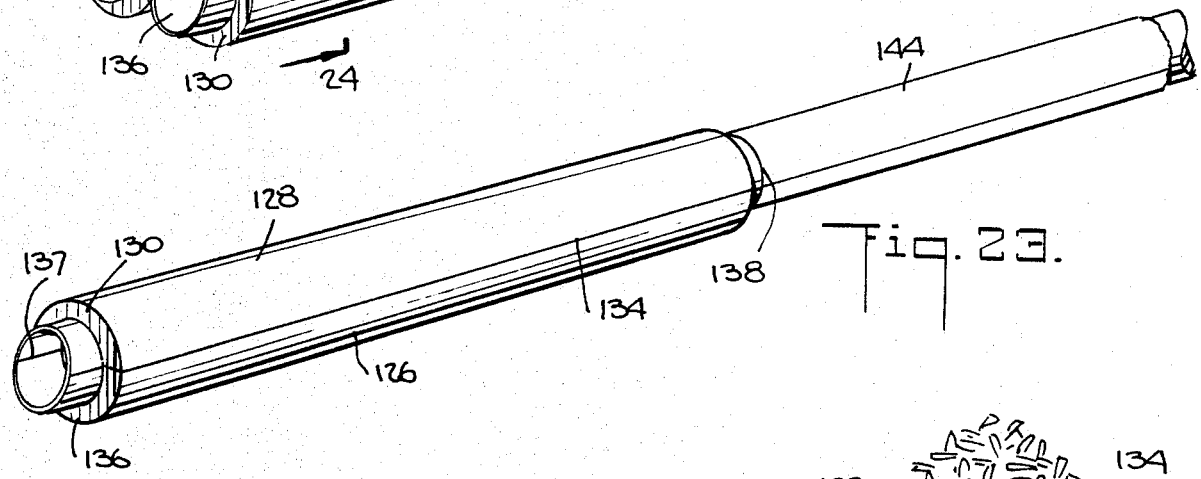
Fig. 23.
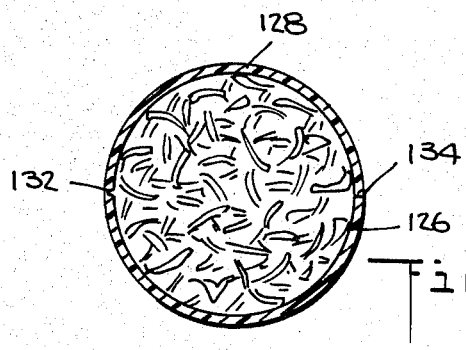
Fig. 25.
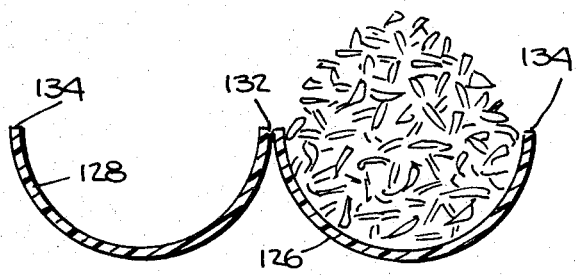
Fig. 24.

Fig. 34.
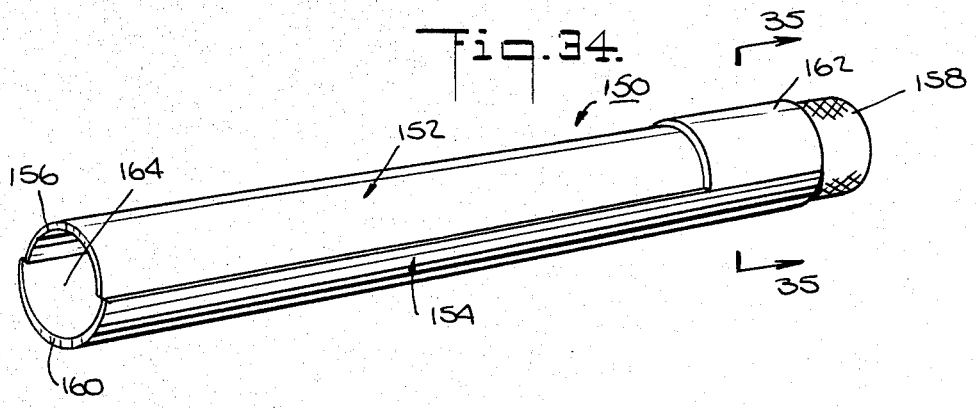
Fig. 36.
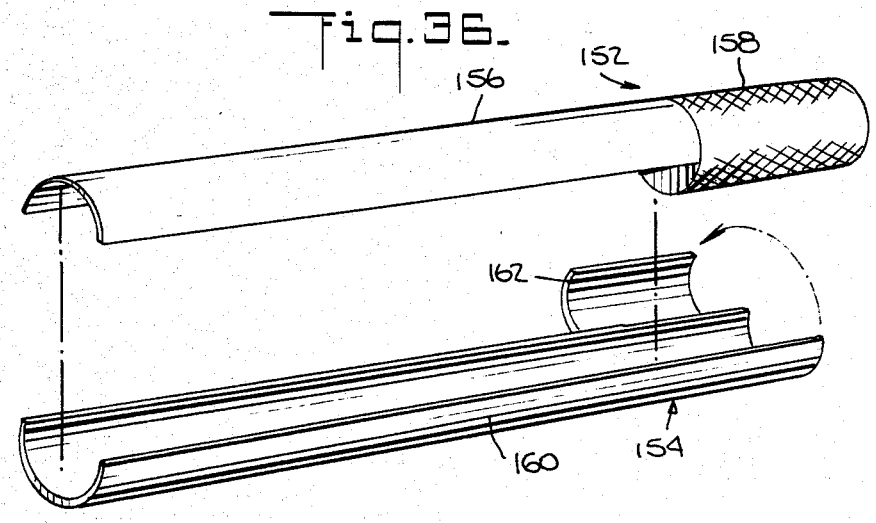
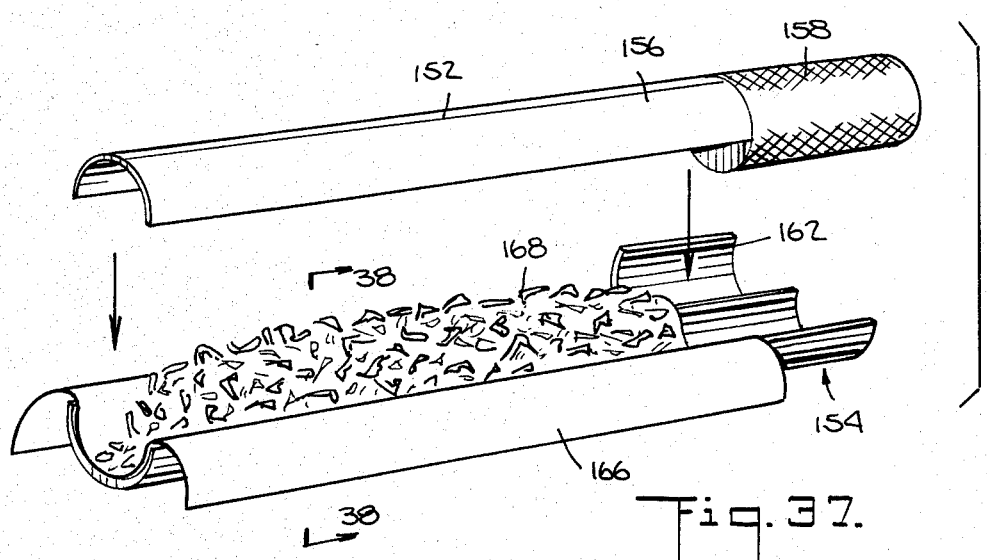
Fig. 37.

162
158
160

158
162
160
40
40
166
156
168

156
166
160
168

166
168
160

158
162
160
154
150
156
170

ROLL-YOUR-OWN CIGARETTE MAKER

BACKGROUND OF THE INVENTION

The present invention pertains generally to cigarette makers, and pertains more particularly to pocket-sized devices for making cigarettes one at a time.

Many cigarette smokers prefer making their own cigarettes to buying them pre-made. One reason for this is that cigarette components, i.e., loose cigarette tobacco and cigarette wraps, are often less expensive than an equivalent number of complete cigarettes. Also, many people find a certain satisfaction in making articles for their own use instead of relying entirely on a commercial manufacturer.

The simplest approach to rolling one's own cigarettes, of course, is to make them from scratch from loose tobacco and cigarette wrappers without any mechanical aids. There are certain disadvantages to this approach, however; it is relatively difficult to obtain a cigarette of uniform density, and inconvenient to make a cigarette in this fashion outdoors in inclement weather.

Simple, relatively compact devices for making cigarettes from scratch have been known for many years. Most such devices, however, although small enough to fit comfortably on a table, are too large and heavy to be genuinely portable. They can be moved from place to place, but cannot be carried in a pocket easily, if at all. In addition, the great majority of such devices require the use of preformed paper tubes. This involves some additional expense, as such tubes may be more expensive than plain cigarette wrappers in leaf form, and it is difficult to form a tube of a specified diameter from a plain wrapper without a mechanical aid. In addition, most such devices are able to manufacture cigarettes only of a single diameter. It would be desirable to provide a genuinely pocket-sized roll-your-own cigarette maker that could be used either with preformed paper tubes or with plain cigarette wrappers. It would also be desirable to provide such a device capable of making cigarettes of different diameters at the pleasure of the user.

It is therefore the principal object of the invention to provide a roll-your-own cigarette maker free of the above-listed short-comings of prior art devices.

It is another object of the invention to provide such a device with which it is possible to roll cigarettes using either premade paper tubes or plain cigarette wrappers.

Still another object of the invention is to provide such a device which is genuinely pocket-sized.

Yet another object of the invention is to provide such a device that is attractive in appearance and simple and reliable in operation.

Still another object of the invention is to provide such a device that is simple and inexpensive to manufacture.

SUMMARY OF THE INVENTION

The invention comprises a compact, preferably pocket-sized roll-your-own cigarette maker having means defining a tobacco chamber for receiving a charge of tobacco for a single cigarette, and mandrel means for use in forming a plain cigarette wrapper into a paper tube. The mandrel means includes a part which serves as a tamper for tamping a charge of tobacco in the chamber, either before or after the wrapper is formed into a tube, in such a manner as to shape the charge of tobacco and to locate it properly relative to the wrapper or paper tube in order to form a cigarette.

According to one preferred embodiment, the tobacco chamber is defined by a cylindrical body having one or more flap-like doors on one side for the insertion of a tobacco charge. Both ends of the chamber are open, one being adapted to receive a paper tube for loading the tobacco charge into the tube, and the other end slidably receiving a cylindrical rod which serves as a mandrel. If plain cigarette papers rather than preformed tubes are used, the paper is wrapped around the mandrel and glued to form a tube, which is then slid off the end of the mandrel and placed at the other end of the tobacco chamber. After the tobacco has been loaded into the chamber, the mandrel is tapped or pushed to tamp the tobacco charge and to load it into the tube.

A retractable stop is preferably provided, comprising a small plate perpendicular to the axis of the device and secured to a paraxial rod slidably received in a sleeve located on the body of the tobacco chamber. The stop is fully extended to permit a paper tube to be placed at one end of the chamber for loading, and is then retracted sufficiently to bring the plate against the free end of the paper tube. After loading, the plate is again extended to permit removal of the cigarette. The rod may alternatively or additionally be rotatable about its own axis to permit the plate to be swung out of the way to allow the paper tube to be placed for loading and the completed cigarette to be removed.

For storage in the pocket, the stop is fully retracted and the mandrel is slid into the chamber, so that the total length of the device is only slightly longer than the tobacco chamber itself. A pocket clip may be attached to permit convenient carrying in the pocket. The mandrel can be removable from the tobacco chamber or can be held therein by means of a flange or the like at one end of the mandrel, permitting the mandrel to slide in, but not to be removed from, the chamber.

In a variation of the first embodiment, the mandrel may have a tongue member secured to the inner end of the mandrel, i.e., in the tobacco chamber. The tongue assists in moving tobacco from the chamber into the paper tube. The tongue can be secured to the mandrel, or can be longitudinally slidable relative thereto. In the latter case, means must be provided to permit the tongue to be locked temporarily in place relative to the mandrel for the tobacco loading process.

In another preferred embodiment, the tobacco chamber is defined by a cylindrical housing which is open at each end as in the first embodiment, and which comprises two approximately semi-cylindrical shells hinged together. The two shells are simply swung open to load the tobacco into the chamber and then are swung closed. A plunger is slidably received in one end of the tobacco chamber for tamping tobacco from the chamber and into a paper tube at the other end of the chamber. As in the first embodiment, the plunger serves as a mandrel for wrapping cigarette tubes of uniform size from cigarette papers. To receive the completed paper tube for loading, the chamber has at one end a nozzle of the same outer diameter as the mandrel. A suitable flange or the like may if desired be provided to prevent the mandrel from being slid out of the tobacco chamber.

Alternatively, the tobacco chamber can be defined by a cylindrical body open at both ends and slit along its length, and made of a resilient substance, so that the chamber can be forced open against its own resilience, loaded and allowed to close up again.

Still another preferred embodiment comprises upper and lower approximately semi-cylindrical tongue members. The lower tongue member, whose upper and lower surfaces are respectively concave and convex, serves as a bed to receive a cigarette paper, on which a load of tobacco is placed. The upper tongue member, which is concave downward and convex upward, is placed on the load of tobacco and used to tamp it down. The approximately cylindrical space defined between the tongue members in this configuration, and occupied by the tobacco, is the tobacco chamber. The cigarette paper is then wrapped over the upper tongue member, which thus serves as the mandrel, and is glued to form a tube, and the upper tongue member is extracted. The upper tongue member preferably has a solid cylindrical portion at one end to be received on one end of the lower tongue piece. This aids in properly positioning the upper tongue piece on the lower. One end of the lower tongue member is preferably provided with a hinged semi-cylindrical flap which, with the portion of the lower tongue member to which it is attached, defines a complete cylindrical ring. The flap is raised, the solid position of the upper tongue piece is placed on the lower, and the flap is closed over the solid portion. Finger pressure on the hinged flap aids in tamping the tobacco into the proper shape on the paper.

According to another preferred embodiment, the cigarette maker of the invention comprises a tongue piece or mandrel having a concave surface on one side and a convex surface on the other. A second element defines a tubular chamber in which the tongue piece can be slidably received. The tubular wall of the second element can be opened to expose the interior of the chamber. Preferably, the wall comprises two parts hinged together about a line parallel to the axis of the chamber. Paper is placed across the two parallel troughs defined by the walls of the open chamber, and the tongue piece is rested on top of the paper with the concave side up. Tobacco is placed on the tongue piece, and the chamber is closed. The tongue piece is then rotated by means of a portion protruding from the chamber. This rolls up the paper, completing the cigarette.

These and many other objects and features of the invention will be more clearly understood from a consideration of the following detailed descriptions of several preferred embodiments thereof, taken in conjunction with the accompanying figures, in which like reference characters refer to like elements throughout.

BRIEF DESCRIPTION OF THE FIGURES

FIG. 21 is a view of the components of another preferred embodiment of the invention.

FIGS. 22 and 23 are perspective views of steps in the use of the device of FIG. 21.

FIG. 24 is a sectional view taken from line 24—24 of FIG. 22.

FIG. 25 is a view taken from line 25—25 of FIG. 23.

FIG. 34 is a perspective view of another preferred embodiment of the present invention.

FIG. 36 is an exploded view of the device of FIG. 34.

FIG. 37 is a view similar to FIG. 36, illustrating the manner of use of the embodiment of FIG. 34.

DETAILED DESCRIPTION OF THE PREFERRED EMBODIMENTS

Figures 1, 2, 3, 4:
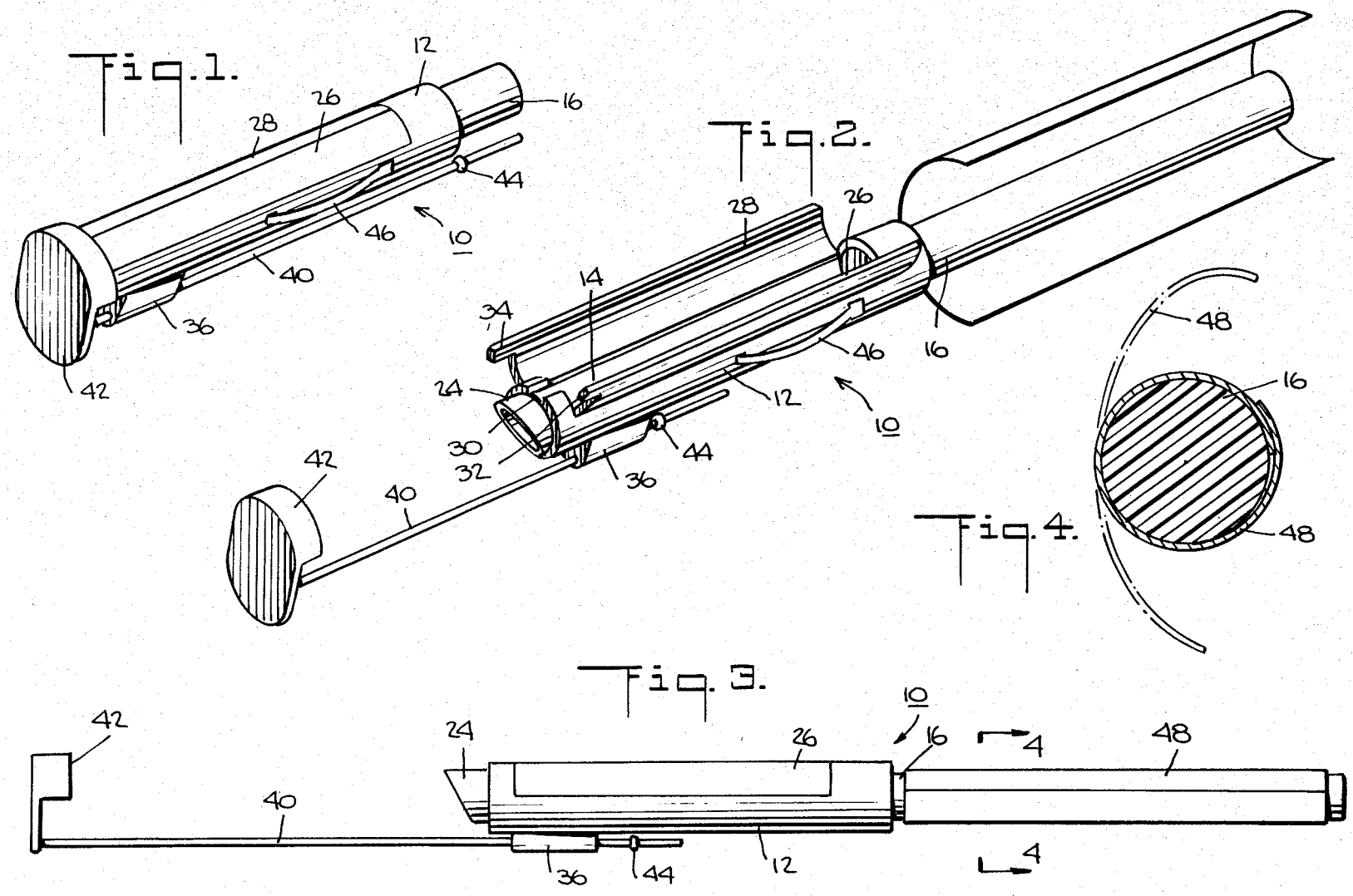
FIG. 1 is a perspective view of a first preferred embodiment of the invention.
FIG. 2 is a second perspective view of the embodiment of FIG. 1, showing the first step in its use.
FIG. 3 is a side view of the device of FIG. 1, illustrating the next step in its use.
FIG. 4 is a sectional view taken from line 4—4 of FIG. 3.

FIGS. 1–10 show a first preferred embodiment 10 of the invention. This embodiment 10 includes a generally cylindrical container 12 defining a tobacco chamber 14 open at both ends (see FIG. 6). A cylindrical mandrel 16 is slidably received in one end of the tobacco chamber 14 (the right-hand end, as shown in the Figures). Both ends of the tobacco chamber 14 preferably have inward-projecting radial flanges 18, 20 to retain the mandrel 16, which has a screw 22 or flange perpendicular to its axis at or near its end received in the chamber 14 (see FIGS. 6, 7 and 10). The left-hand end of the tobacco chamber 14, as shown in the Figures, is provided with a nozzle 24 defining a longitudinal passageway by which tobacco is moved out of the chamber 14. The outer diameter of the nozzle 24 is the same as that of the mandrel 16.

The upper portion of the lateral surface of the generally cylindrical container 12 has a relatively large, generally rectangular aperture covered by two flap-like doors 26, 28 that, when closed, are flush with the rest of the container wall and that can be opened for loading tobacco into the chamber 14. The doors 26, 28 are preferably hinged to the container 12 in any suitable known manner. To facilitate opening the doors 26, 28, a small portion of the container wall between the doors 26, 28 and the end of the tobacco chamber adjacent the nozzle 24 is cut out (at 30), and each door 26, 28 is provided with a small stud 32, 34 that, when the doors 26, 28 are closed, lies within the cut-out portion 30 and is flush with the remainder of the tobacco chamber wall (see especially FIG. 2).

On the side of the tobacco chamber wall opposite the doors, preferably adjacent the end of the chamber 14 carrying the nozzle 24, a lug member 36 having a bore 38 parallel to the direction of movement of the mandrel 16 is provided. A rod 40 is slidably received in the bore 38. A plate 42 is affixed to one end of the rod 40 generally perpendicular thereto, and the portion of the rod 40 on the other side of the lug member 36 is provided with a knob 44 or similar detent element to prevent the rod 40 from being removed from the bore 38. The rod 40 is long enough to permit the plate 42 to be moved a greater distance from the nozzle 24 than the length of the mandrel 16. Alternatively, or in addition, the rod 40 is rotatable as well as slidable within the bore 38.

A clip 46 for holding the device 10 in the pocket is provided on one side of the container 12.

Figure 5:
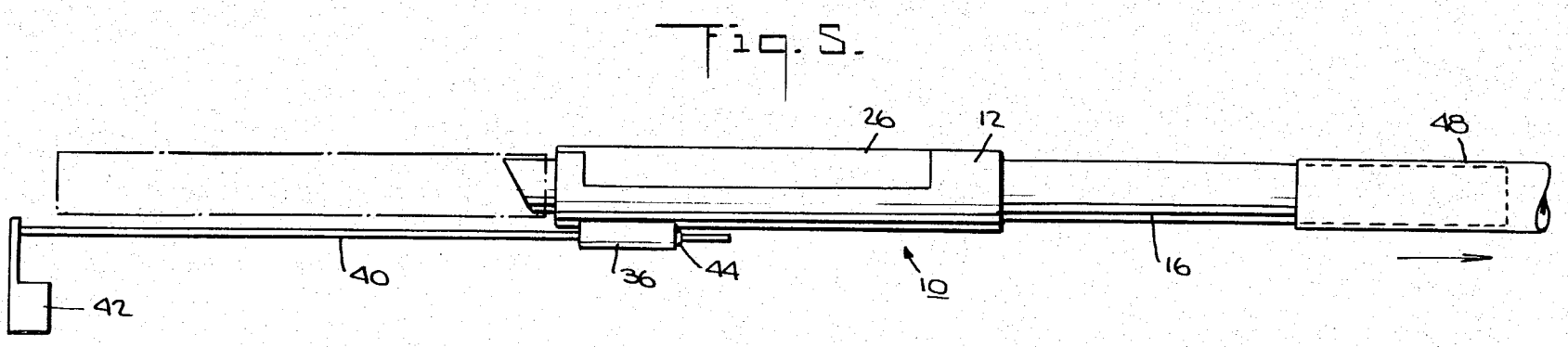
FIG. 5 is a view similar to that of FIG. 3, showing the next step in the operation of the device of FIG. 1.
Figure 6:
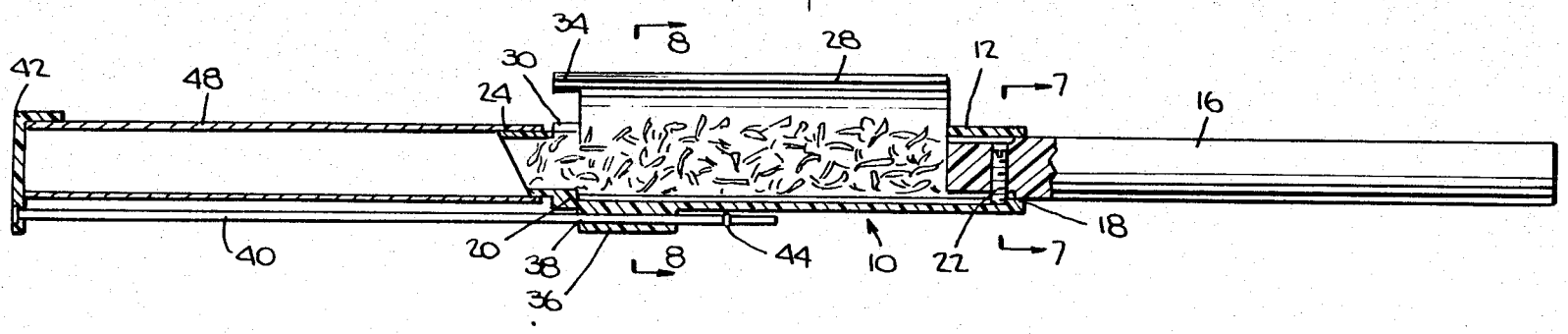
FIG. 6 is a side view of the device of FIG. 1, partly in section, showing the next step in the use of the device.

The use of the device 10 of FIG. 1 will now be described, with reference to FIGS. 2–10. The mandrel 16 is first extended to its full length, as shown in FIG. 2. A cigarette paper is then wrapped around the mandrel 16, as indicated in FIGS. 2–4, and is glued to form a paper tube 48. The paper tube 48 is then slid off the end of the mandrel 16 and fitted over the nozzle 24, as indicated in phantom in FIG. 5. To permit this to be done, the stop plate 42 is moved out of the way of the nozzle 24. This can be done by extending the rod 40 sufficiently for the paper tube 48 to clear the stop plate 42, or by rotating the rod 40, or both, as illustrated in FIG. 5. When the paper tube 48 is in place on the nozzle 24, the stop plate 42 is moved into engagement with the end of the tube 48, as indicated in FIG. 6. This holds the tube 48 firmly in place on the nozzle 24 during the loading of the tobacco into the tube 48.

Figure 10:
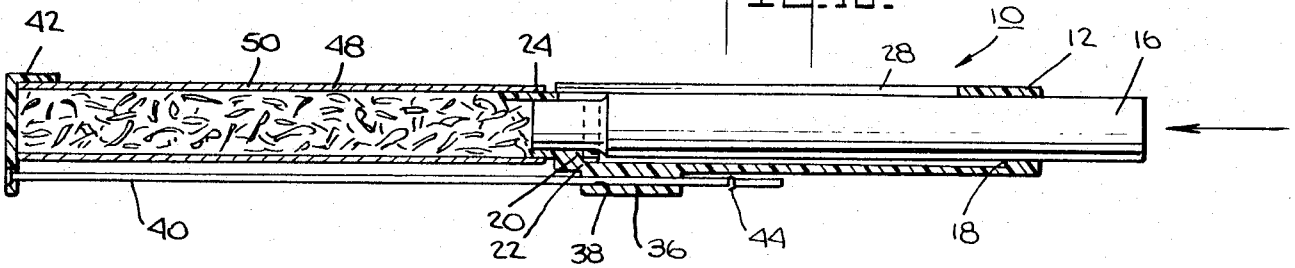
FIG. 10 is a view similar to that of FIG. 6, illustrating the next step in the use of the device of FIG. 1.
Figure 7:
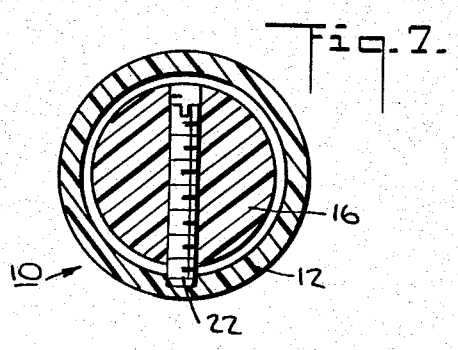
FIGS. 7 and 8 are sectional views taken from lines 7—7 and 8—8 in FIG. 6, respectively, showing details of the construction and use of the device.
Figure 9:
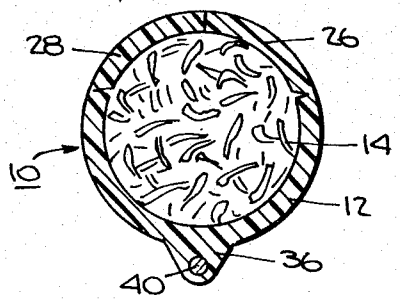
FIG. 9 is a view similar to that of FIG. 8.
Figure 8:
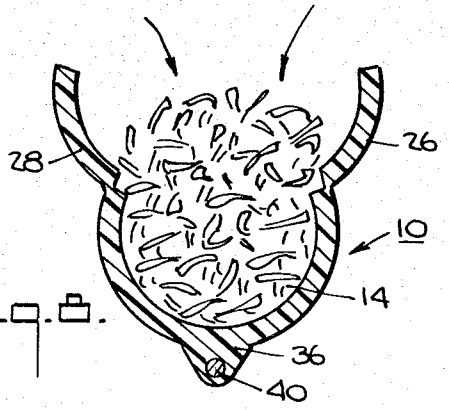

The tobacco is then placed in the chamber 14 via the open flap doors 26, 28 (see FIGS. 6 and 8), which are then closed, somewhat compressing the tobacco (FIG. 9). The mandrel 16 is then tapped or pushed axially to move the tobacco through the nozzle 24 into the paper tube 48, further compressing the tobacco due to the difference between the inner diameters of the tobacco chamber 14 and of the nozzle 24. When the mandrel 16 has been moved the full length of the chamber 14, the cigarette 50 is complete (FIG. 10). The stop plate 42 is then disengaged from the end of the cigarette 50, again by rotation or by extension of the rod 40, and the cigarette 50 is removed from the nozzle 24.

Figure 11:
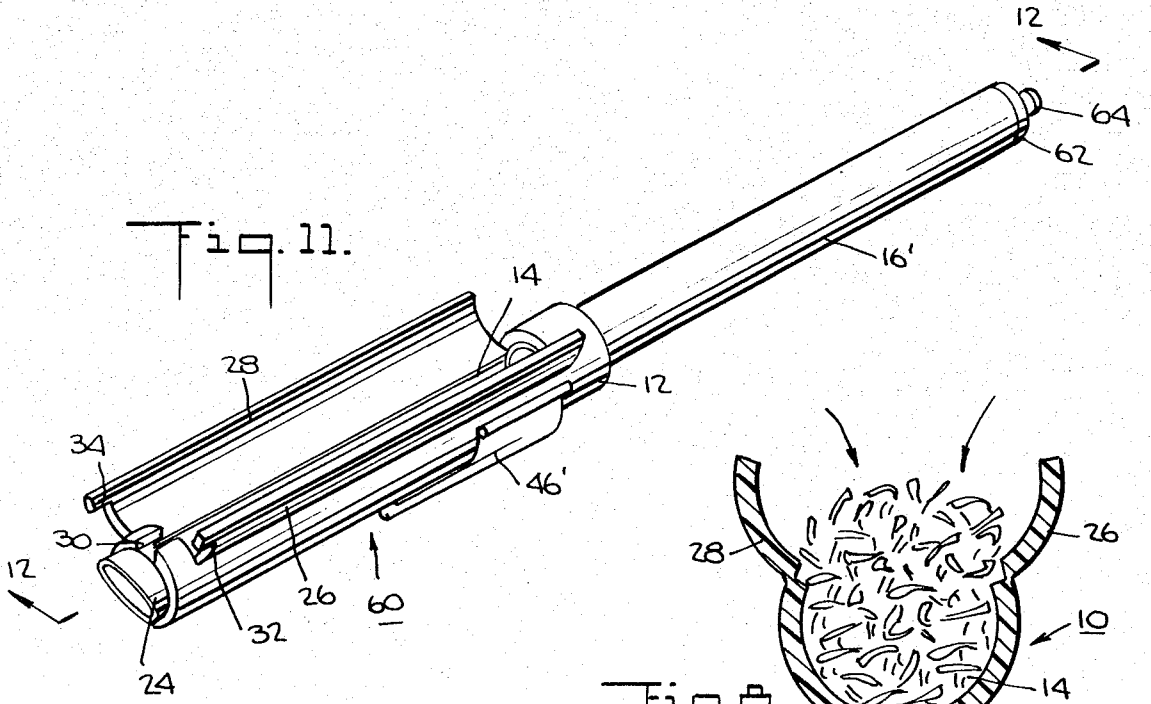
FIG. 11 is a perspective view of a variation of the embodiment of FIG. 1.
Figure 12:
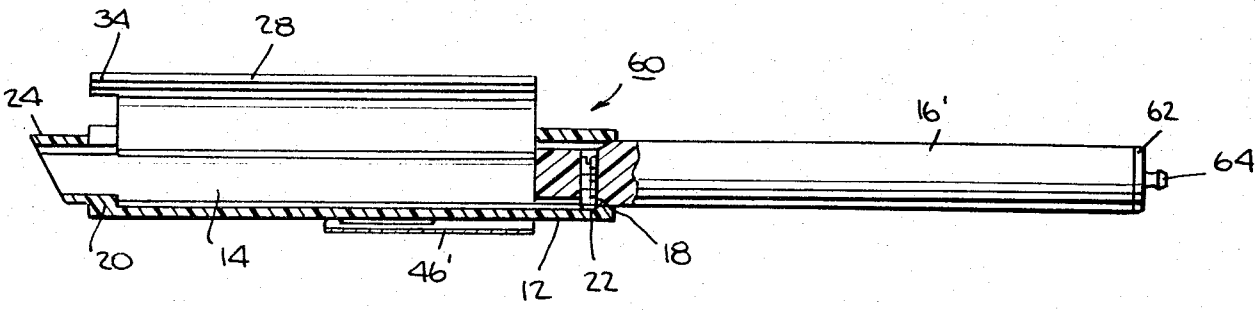
FIG. 12 is a view, partly in section, taken from line 12—12 in FIG. 11.

A variation 60 of the embodiment of FIGS. 1–10 is shown in FIGS. 11 and 12. In this version, no stop plate, lug member or stop plate rod is provided. In addition, the pocket clip 46′ in this embodiment is a snap-on piece rather than an element molded in place in, or riveted to, the container 12 as in the preceding embodiment 10. The projecting end of the mandrel 16′ is provided with an end cap 62 having a central boss or knob 64, to make the device more attractive. The operation of the embodiment 60 of FIGS. 11 and 12 is the same as that of the preceding embodiment 10 except, of course, that there is no stop plate to be manipulated.

FIGS. 13–20 show another preferred embodiment of the invention. In this embodiment 17, the tobacco chamber 71 is defined by a cylindrical shell 72 open at both ends and having flap-like doors 74, 76 and a pocket clip 78. As in the embodiment 10 of FIGS. 1–10, the flap doors 74, 76 have short stud portions 75, 77 to facilitate manipulation of the doors 74, 76, the stud portions 75, 77 being received in a cut-out area 79 overlying the nozzle 80. A nozzle 80 is provided at one end of the chamber. A hollow cylindrical sleeve 82 slidably received in the other end of the tobacco chamber serves as the mandrel. The sleeve 82 preferably has one or more flanges or similar detent members 84 to retain it in the tobacco chamber 71, as in the embodiment of FIGS. 1-10. The end 86 of the sleeve 82 projecting from the chamber 71 is preferably knurled to facilitate handling.

The mandrel 82 has a longitudinal slot 88 extending from a short distance ahead of the knurled end 86 to a short way behind the other end 90 of the sleeve 82. The end 92 of the slot 88 nearer end 90 of sleeve 82 is widened to give the slot 88 as a whole an L-shape (see FIG. 15). A separate tongue member 94 is provided, having a short cylindrical plug or body 96 equal in diameter to the inner diameter of the mandrel 82. The cylindrical plug 96 has a small tooth or detent 98 on its lateral surface to be received in the mandrel slot 88. Attached to one end of the plug 96 is a tongue piece 100 having the shape of a segment of a cylindrical shell. The tongue piece 100 is concave upward (i.e., in the direction of the tooth 98), and has the same radius of curvature on its convex side as the inner surface of the sleeve 82. As in the foregoing embodiments, the outer diameters of the sleeve 82 and of the nozzle 80 are the same, while the nozzle inner diameter has the same radius of curvature as the concave surface of the tongue piece 100.

Figures 13, 14, 15, 16:
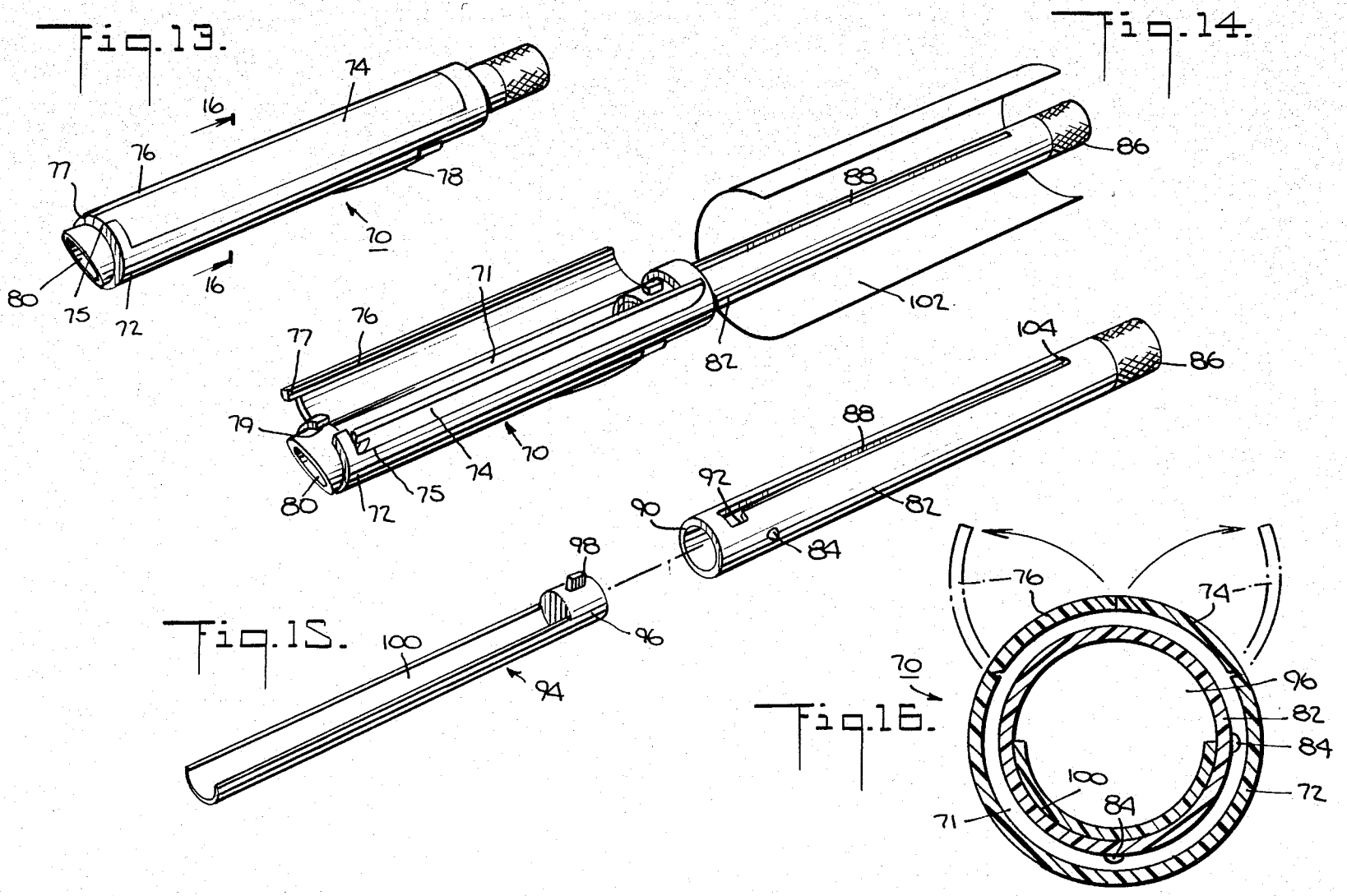
FIG. 13 is a perspective view of another preferred embodiment.
FIG. 14 is a view similar to that of FIG. 13, showing the first step in using the device.
FIG. 15 is a perspective view of two components of the device of FIG. 13, showing the manner in which they are assembled.
FIG. 16 is a view taken from section line 16—16 of FIG. 13.
Figures 17, 18, 19, 20:
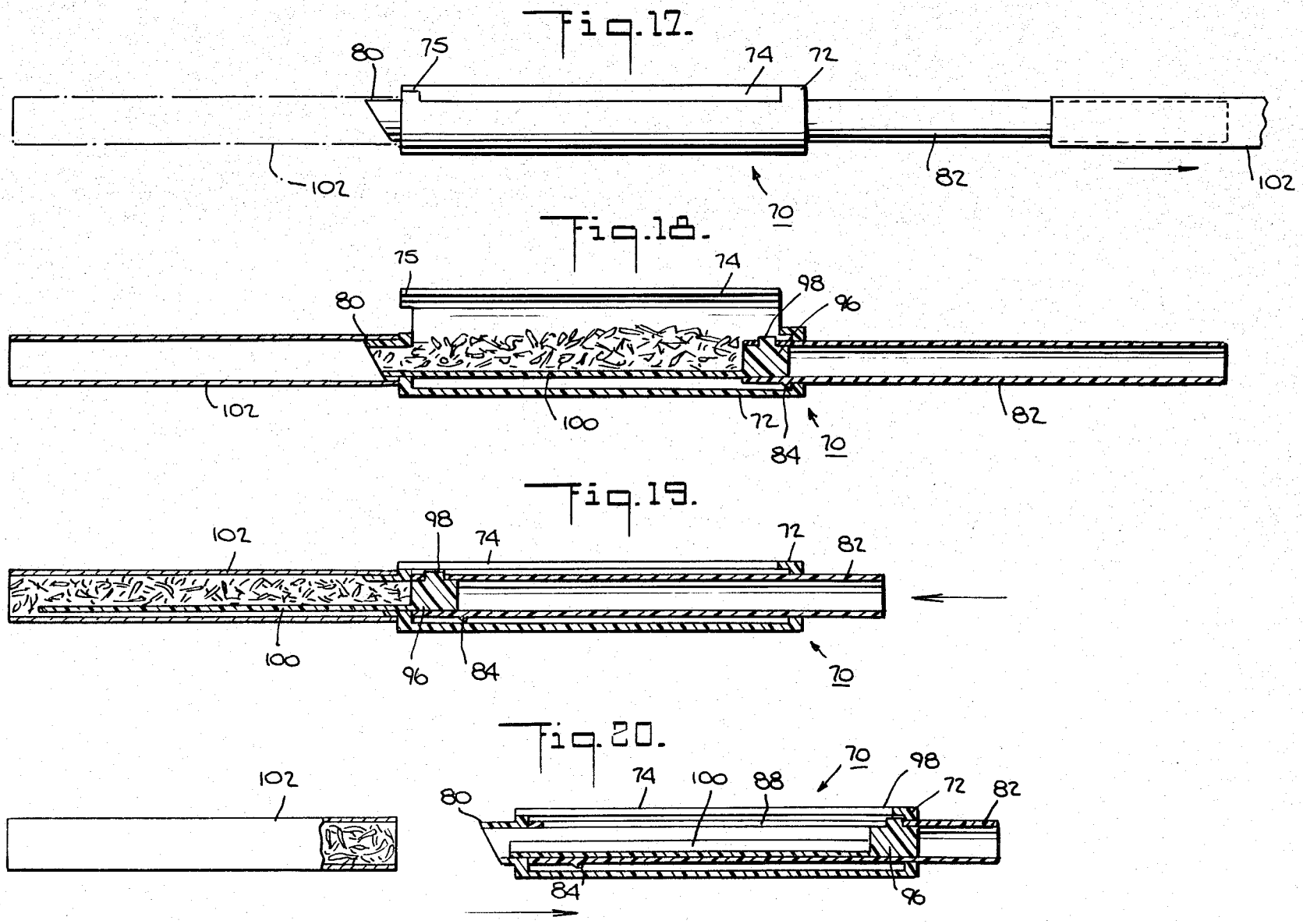
FIG. 17 is a side view showing a further step in the use of the device of FIG. 13.
FIGS. 18–20 are side sectional views showing further steps in the use of the device of FIG. 13.
Figure 26:
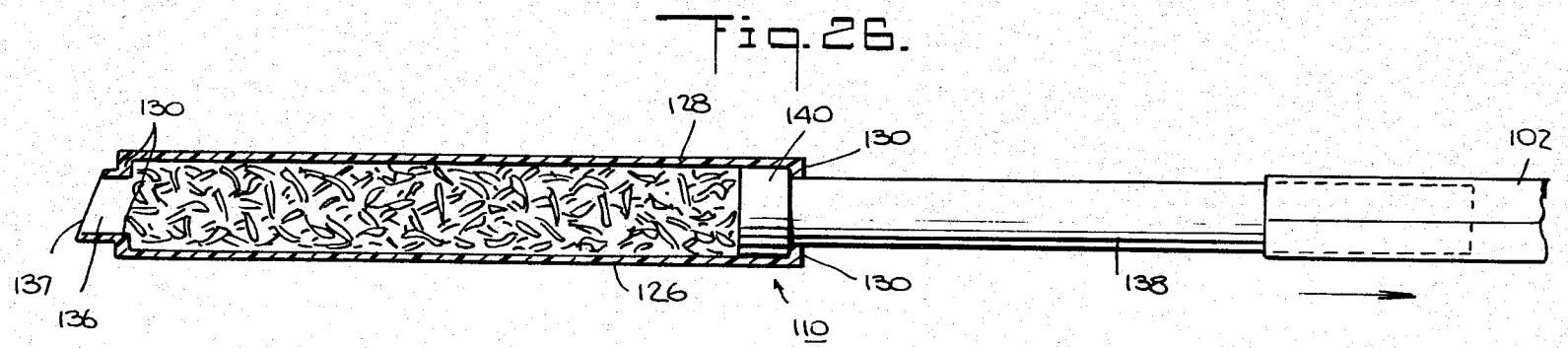
FIGS. 26–28 are side views, partly in section, showing further steps in the use of the device of FIG. 21.

The elements described are combined as indicated in FIGS. 15 and 16. The tongue piece 100 is received in the interior of the sleeve 82, the tooth 98 fitting in the slot 88 of the sleeve 82. The sleeve 82, in turn, is received inside the tobacco chamber 71.

In use, the sleeve 82 is extended from the tobacco chamber 71, and is rotated so that the tooth 98 on the tongue member 94 fits in the widened portion 92 of the slot 88, preventing relative axial motion of the tongue member 94 and the mandrel sleeve 82.

A paper tube 102 is formed about the mandrel 82 from a flat cigarette paper in the same manner as in the embodiments already described, and is then transferred from the mandrel 82 to the nozzle 80 at the other end of the tobacco chamber 71. The tobacco is then loaded into the chamber 71 via the open flap doors 74, 76. After the doors 74, 76 are closed, the mandrel 82 is tapped or pushed to move the tobacco from the chamber 71, through the nozzle 80 and into the paper tube 102. Retraction of the mandrel 82 to withdraw the tongue piece 100 from the cigarette completes the process, and the cigarette is ready to be removed from the nozzle 80.

For compact storage, the mandrel 82 is rotated so that the tooth 98 becomes free to move along the longitudinal portion of the slot 88. The mandrel 82 is then slid into the tobacco chamber 71, the tooth 98 moving along the slot 88 to the narrow end 104, so that the device assumes the form shown in FIG. 13, with both the mandrel 82 and the tongue member 94, in the tobacco chamber 71, with only the knurled end 86 of sleeve 82 protruding. In this configuration, the device 70 can be compactly stored in the pocket.

A variant of this embodiment has the tongue piece integral with the mandrel sleeve, eliminating the need for the slot and tooth arrangement but approximately doubling the overall length of the device.

FIGS. 21–33 show two other embodiments 110, 120 of the invention. In these embodiments, the tobacco chamber is defined by a cylindrical element, which may be a single length of resilient tubing 122 having a longitudinal slit 124 in it, as shown in FIGS. 29–33, or may be defined by two semi-cylindrical shells 126, 128 hinged together, as in FIGS. 21–28. In either case, a small radial flange 130 is preferably provided at each end of the device. Each flange 130 is slitted (at 131) along the length of the diameter that intersects the longitudinal slit 124 (FIG. 29) or slits 132, 134 (FIG. 21) in the lateral wall of the cylinder, so that the flanges 130 do not interfere with the opening of the cylinder.

At one end of the tobacco chamber, a nozzle 136 is preferably attached to the radial flange 130. The nozzle 136 is divided in two by slits 137 at the same circumferential locations as the flange slits 131. A mandrel 138 is slidably received in the other end of the chamber. Preferably, the end of the mandrel 138 received in the chamber is thickened or has a radial flange 140 to prevent the mandrel 138 from accidentally slipping out of the tobacco chamber. The mandrel 138 (except at the thickened portion 140) and the nozzle 136 have the same outer diameter.

Figure 27:
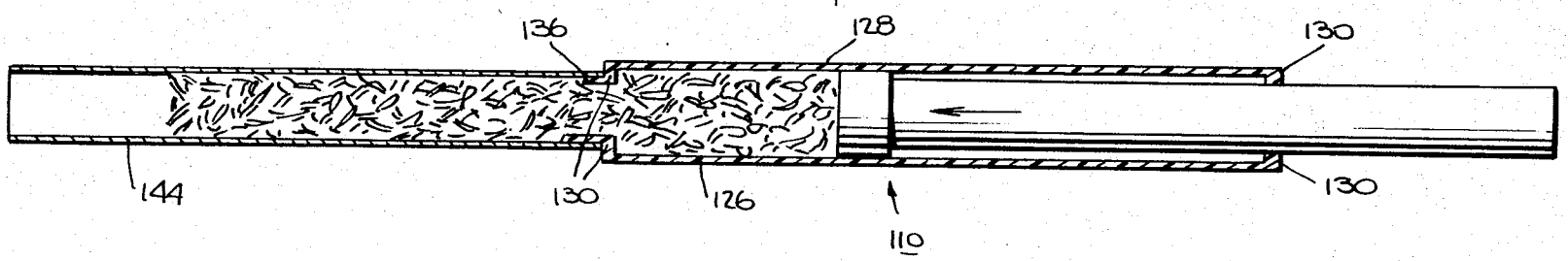
Figure 28:
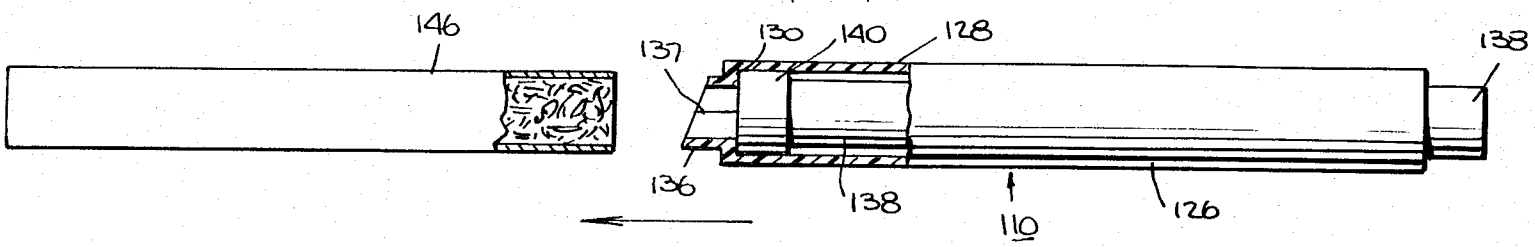
Figure 29:
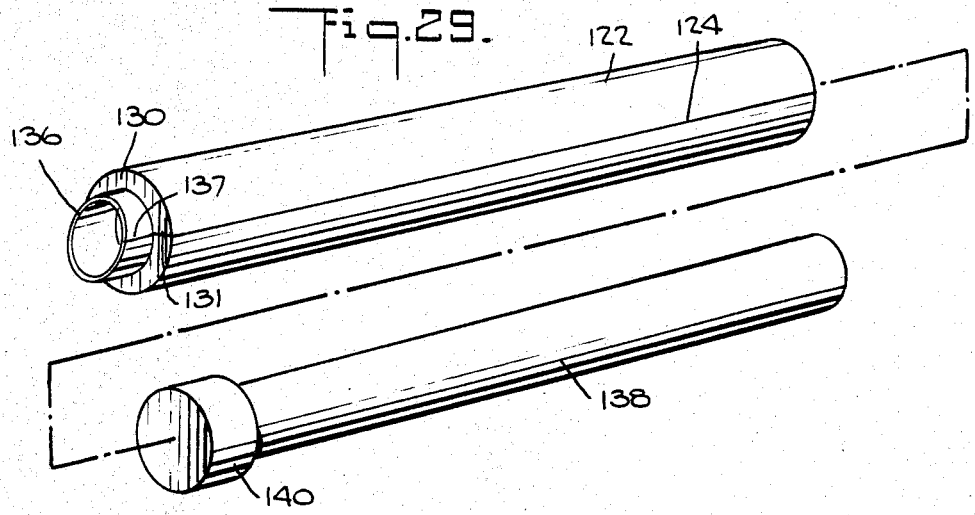
FIGS. 29–33 are views corresponding respectively to FIGS. 21–25, showing a variation of the embodiment of FIG. 21.
Figure 30:
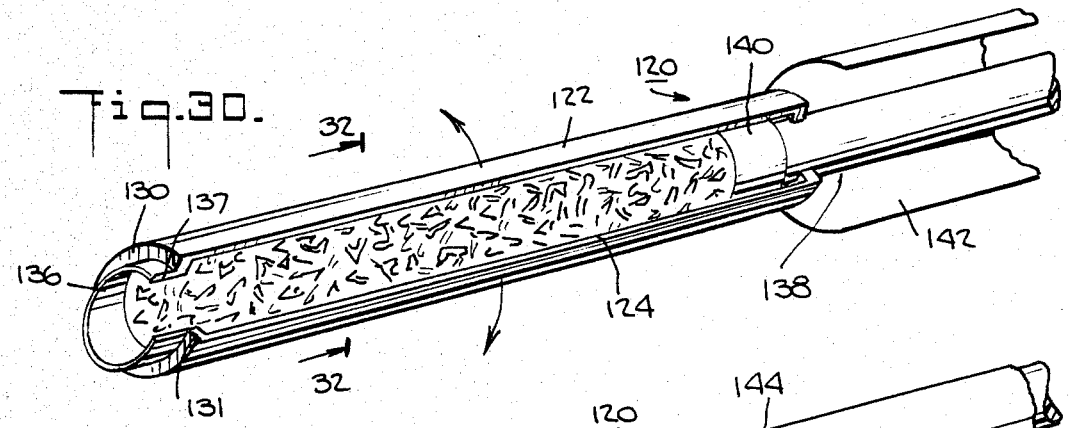
Figure 31:
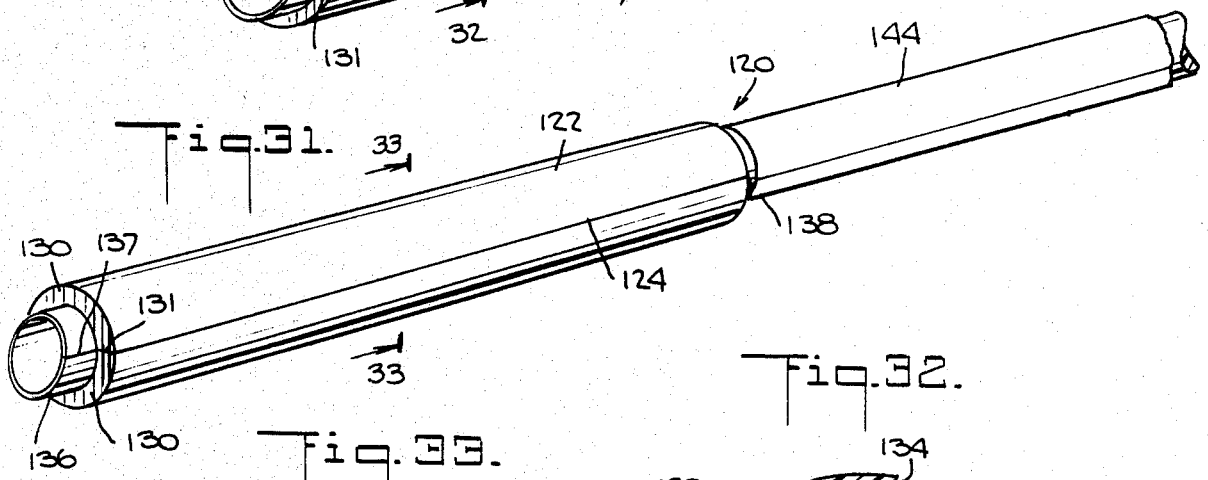
Figure 32:
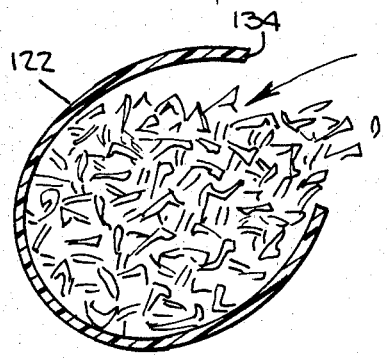
Figure 33:
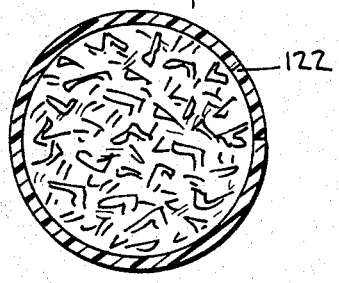

In use, the tobacco chamber is opened and loaded with tobacco, as indicated in FIGS. 22 and 24, and in FIGS. 30 and 32. With the hinged version (in FIGS. 22 and 24), the semi-cylindrical shells 126, 128 are pivoted open about the hinge 132. In the version 120 shown in FIGS. 30 and 32, the chamber is opened against the resilience of the material 122 to permit the tobacco to be loaded through the longitudinal slit 124. In both versions, a piece of cigarette paper 142 is wrapped around the mandrel 138 and glued to form a tube 144 (FIGS. 22–23, 30–31). The formed tube 144 is slid off the end of the mandrel 138 (FIG. 26) and fitted over the nozzle 136 at the other end of the tobacco chamber, and the mandrel 138 is then tapped or pushed to compress the tobacco charge and to move it from the chamber into the tube 144 (FIG. 27). The completed cigarette 146 is then taken from the nozzle 136 (FIG. 28).

The embodiments 110, 120 of FIGS. 21–33, like the others illustrated, can if desired be provided with a pocket clip for convenient carrying.

Another preferred embodiment 150 of the present invention and its method of use are illustrated in FIGS. 34–41. As seen most clearly in FIG. 36, the roll-your-own cigarette maker 150 of this embodiment comprises an upper tongue piece 152 and a lower tongue piece 154. The upper tongue piece 152 includes an approximately semi-cylindrical shell 156 that, in the orientation shown in FIG. 36, is concave downward, together with a preferably cylindrical plug 158 at one end of the shell 156. The lateral surface of the plug 158 is knurled and, neglecting the knurling, is flush with the adjacent portion of the outer surface of the shell 156.

The lower tongue piece 154 comprises a generally semi-cylindrical shell 160 concave upward in FIG. 36 and equal in length to the entire upper tongue piece 152. At one end, the lower tongue piece 154 includes a flap 162 secured to the tongue piece 154 at one edge of the latter, so that the flap 162 can be folded over the shell 160. The flap 162 also has the shape of a semi-cylindrical shell, and when folded over shell 160 cooperates therewith to define a cylindrical space whose diameter is equal to the outer diameter of the upper tongue piece plug 158, as indicated in FIG. 34. As can be seen, the upper and lower tongue pieces 152, 154 define a generally cylindrical tobacco chamber 164 between them when the upper tongue piece plug 158 is placed on the lower tongue piece 154 with shell 156 extending along shell 160 and the flap 162 is folded over the plug 158.

If the lower tongue piece 154 is made of a plastic material, the flap 162 can be connected to the shell 160 of the lower tongue piece 154 simply by a thinned portion of the same material. If metal is used, the flap 162 must be a separate piece from shell 160 and must be hinged thereto in any suitable known fashion.

The manner of using the device 150 of FIG. 34 will be explained with reference to FIGS. 37–41. A piece of cigarette paper 166 is laid on the lower tongue piece 154, leaving the portion of shell 160 beside the flap 162 uncovered, as shown in FIG. 37. Loose tobacco 168 is sprinkled on the paper 166 in the trough defined by the lower tongue piece 154.

With the flap 162 open, as shown in FIG. 37, the upper tongue piece plug 158 is placed on the lower tongue piece 154 beside the flap 162, with shell 156 of the upper tongue piece 152 resting on the tobacco 168. The upper and lower tongue pieces 152, 154 are then pressed together. Although this can be done entirely manually, it is convenient to fold the flap 162 over the upper tongue piece plug 158 as in FIG. 39, pressing the upper tongue piece 152 down onto the tobacco 168 and tamping the latter into the proper form. Using the hinged flap 162 in this manner also insures that the upper and lower tongue pieces 152, 154 are properly aligned for the next step, while tamping the tobacco 168 in this manner forces it into the proper cylindrical shape.

Figures 35, 38, 39, 40, 41:
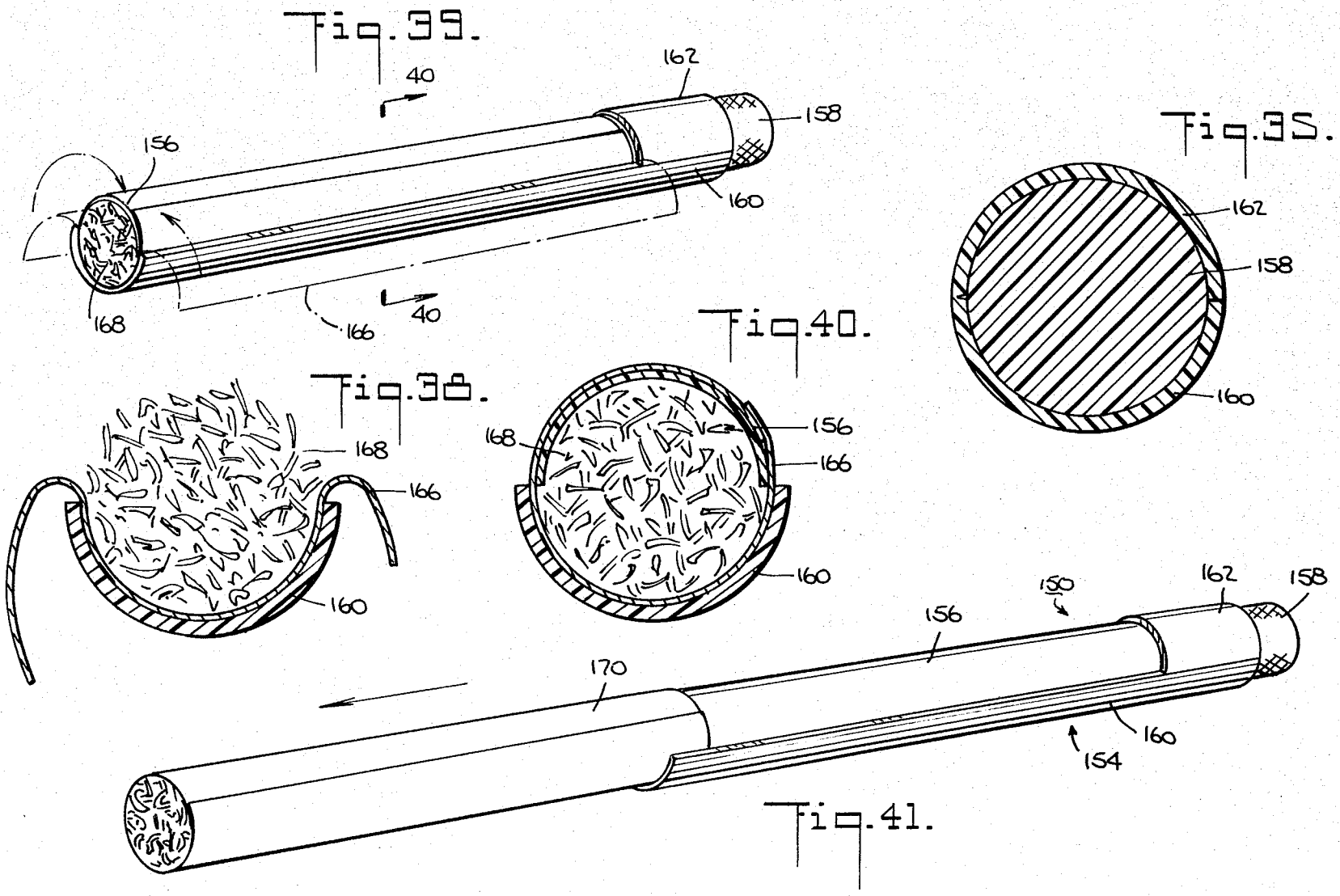
FIG. 35 is a sectional view taken from line 35—35 of FIG. 34.
FIG. 38 is a sectional view of the embodiment of FIG. 37, taken from section line 38—38 of FIG. 37.
FIG. 39 is a perspective view similar to that of FIG. 34, illustrating a further step in the use of the embodiment of FIG. 34.
FIG. 40 is a sectional view taken from line 40—40 of FIG. 39.
FIG. 41 is a perspective view showing the final step in the use of the device of FIG. 34.

The ends of the paper 166 are then folded up over the upper tongue piece 152 (see FIGS. 39 and 40) and are glued in the conventional manner to form a tube. The complete cigarette 170 is removed from the upper tongue piece 152 by opening the flap 162 and separating the upper and lower tongue pieces 152, 154, and then withdrawing the cigarette over the end of the latter. The cigarette 170 can, of course, also be removed without separating the tongue pieces 152, 154, as indicated in FIG. 41.

Although the upper and lower tongue pieces 152, 154 are shown as separate elements, the two may be connected, for example by providing a hinge to connect the lower portion of the end of the upper tongue piece plug 158 to the corresponding portion of the end of the lower tongue piece 154 adjacent the flap 162. If the cigarette maker 150 is made of plastic, this can be done by leaving a flap of plastic to serve as the hinge. In addition, the respective curvatures of the tongue piece shells 156, 160 may subtend less or more than 180°, and their sum need not equal 360° unless an exactly circular cylinder is desired for the tobacco chamber.

Another preferred embodiment 180 is shown in FIGS. 42–48. This embodiment includes a tongue member 182 concave on one side and convex on the other and defining a portion of a cylindrical shell. A solid cylindrical plug 184, disposed at one end of the tongue member 182 and preferably knurled on its outer surface, serves as a handle, as described below.

Figure 42:
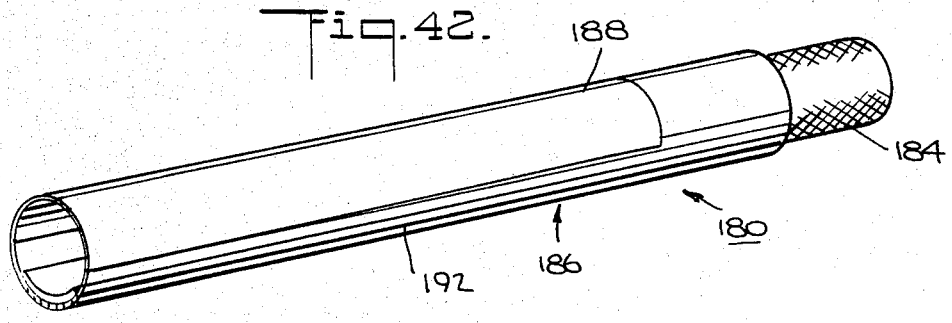
FIG. 42 is a perspective view of still another preferred embodiment of the invention.

This embodiment 180 also includes a tubular chamber 186 of circular cross-section whose inner radius of curvature is equal to that of the tongue member 182. One portion of the wall of the chamber 186, extending from one end somewhat less than the entire length thereof, is a piece 188 separate from the remainder of the chamber wall and is hinged thereto along a line 190 parallel to the chamber axis. For storage, the chamber 186 is closed and the tongue member 182 is slid into the chamber 186, as shown in FIG. 42.

If desired, a locking device (not shown) can be provided to prevent the tongue member 182 from accidentally falling out of the chamber 186. In addition, a pocket clip (not shown) can, if desired, be provided on the exterior wall of the chamber 186.

Figure 43:
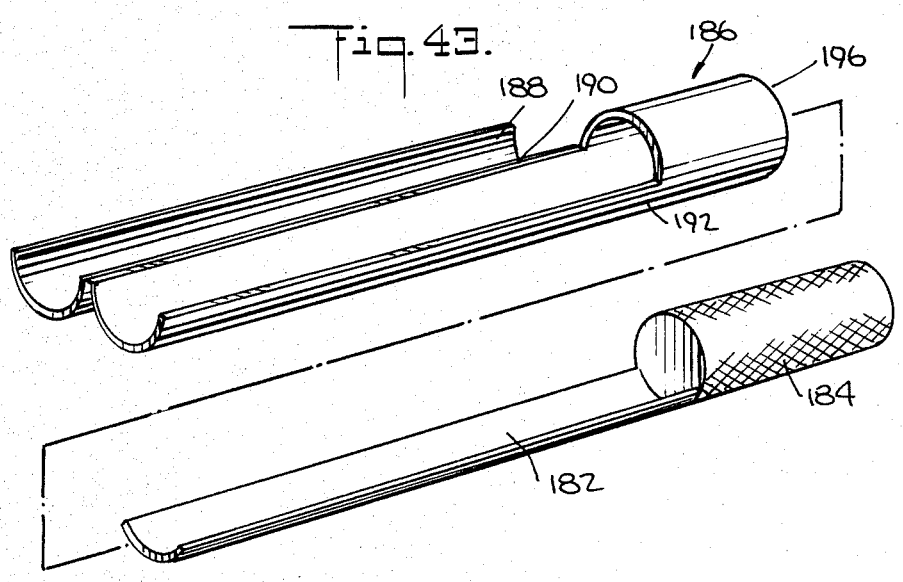
FIG. 43 is a view showing the device of FIG. 42 disassembled.
Figure 44:
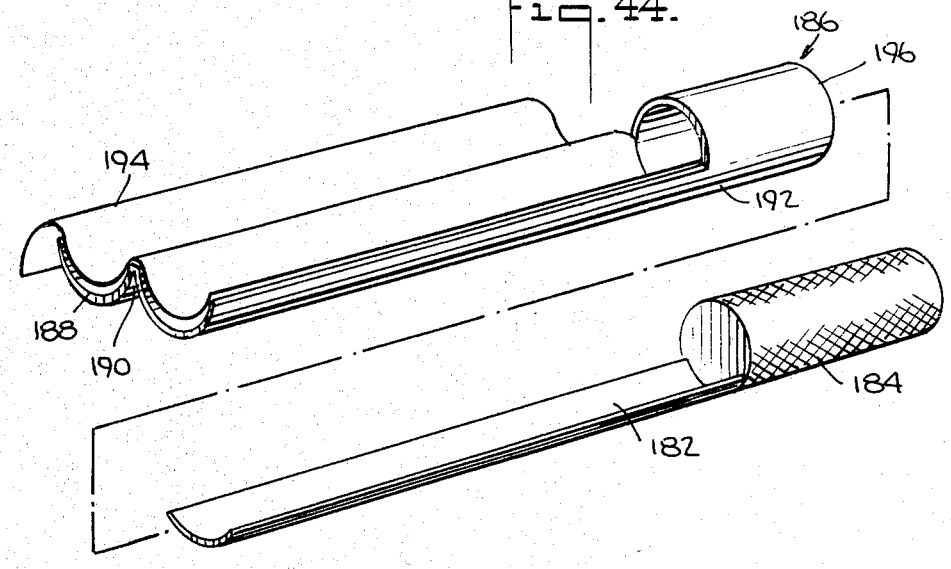
FIGS. 44–48 are perspective views showing the manner of using the device of FIG. 42.
Figure 45:
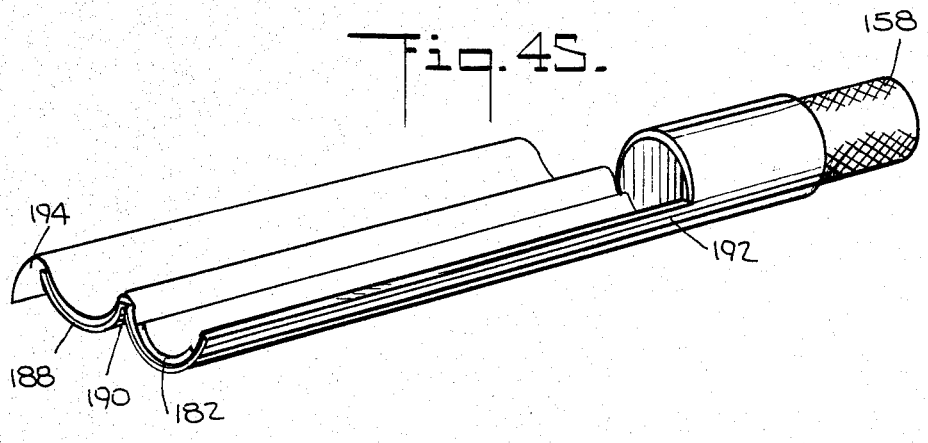
Figure 46:
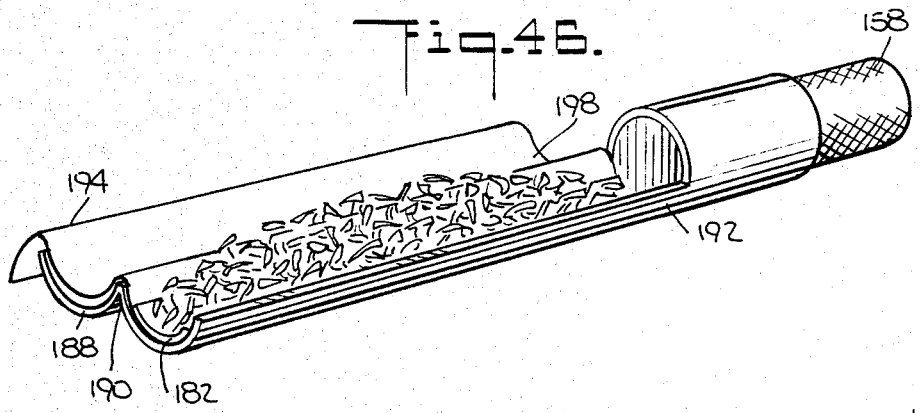
Figure 47:
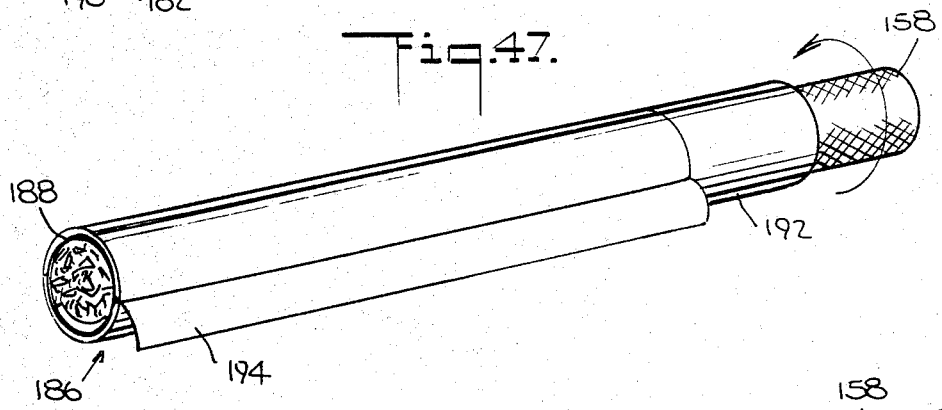
Figure 48:
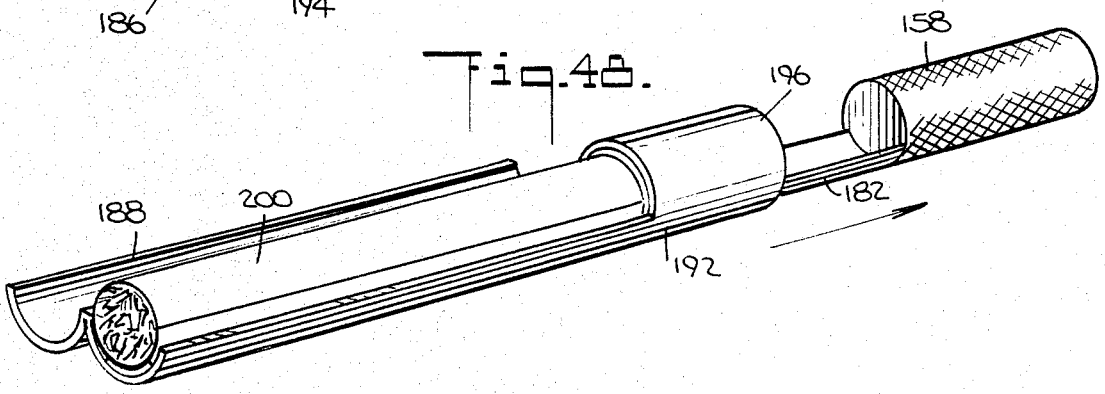

In use, the tongue member 182 is removed from the chamber 186, and the chamber is opened to the position shown in FIG. 43, with the two portions 188, 192 of the chamber wall defining a double trough having a shape somewhat like a "w" if viewed end on. A cigarette wrapper 194 is laid across the double trough (FIG. 44), and is held down with the thumb while the tongue member 182 is inserted through the other end 196 of the chamber 186 in such a manner that the tongue member 182 rests on the paper 194 (FIG. 45). The tobacco 198 is then placed on the tongue member 182 (FIG. 46). The flap 188 of the chamber is folded over to the closed position, compacting the tobacco and folding the paper 194 into a tube (FIG. 47).

At this point, a portion of the tobacco wrapper 194 hangs out the side of the chamber 186. The tongue piece 182 is now rotated about its own axis by means of the knurled handle 184, as indicated by the arrow in FIG. 47, rolling the wrapper 194 around the tobacco. When the wrapper 194 has been completely rolled up, the chamber 186 is opened (FIG. 48), the tongue piece 182 is slid out of the cigarette 200, and the loose ends at one end of the cigarette are tamped for firmness. The cigarette is now complete.

It will be appreciated, of course, that preformed cigarette tubes can be used with many of the embodiments of the invention, if desired.

The invention has been shown and described herein as adapted for making cigarettes of circular cross-section, but the shape of the mandrel, chamber and nozzle (in those embodiments having one) can be varied to produce cigarettes of other shapes as well, e.g. oval, square or hexagonal.

Although the present invention has been described in detail with reference to several preferred embodiments thereof, many modifications and variations thereof will now be apparent to those skilled in the art. Accordingly, the scope of the invention is to be limited, not by the details of the illustrative embodiments described, but only by the terms of the appended claims.

I claim:

1. A pocket-sized roll-your-own cigarette maker comprising a body portion having two open ends and having a surface which has a third opening substantially larger than said open ends, first and second flaps hinged to said body portion for closing said third opening, a longitudinal flange disposed at one of said open ends for receiving a cigarette tube to be filled with tobacco, and a mandrel slidably received in the other of said open ends, said mandrel being slidable to an extended position to expose its surface for use to wrap a cigarette paper into a tube and being slidable from said extended position along the full length of said body portion to move the entire contents of said body portion through said one open end and into a paper tube received on said longitudinal flange; said longitudinal flange and said mandrel having equal outer diameters.

2. The cigarette maker of claim 1, further comprising stop means for aiding in retaining a paper tube in place to be filled with tobacco.

3. The cigarette maker of claim 2, wherein said body portion includes a portion having a bore, and wherein said stop means comprises a rod slidably received in said bore.

4. The cigarette maker of claim 3, wherein said stop means further comprises an element disposed on said rod, said element being slidable between a storage position in which said element abuts said longitudinal flange and a stop position in which said element is properly spaced from said storage position to abut a cigarette tube of a given length received on said longitudinal flange.

5. The cigarette maker of claim 4, wherein said element is further slidable to a disengage position further from said storage position than is said stop position.

6. A pocket-sized roll-your-own cigarette maker comprising means defining a generally cylindrical tobacco chamber having first and second opposing open ends and having in its lateral surface an additional opening for loading a tobacco charge into said chamber; said second open end being for transferring a charge of tobacco from said tobacco chamber into a paper tube located adjacent said second open end; and mandrel means having one end slidably received in said first open end of said chamber, and being extendable for use as a mandrel for receiving paper therearound for forming a paper tube for a cigarette; said mandrel means including tamper means being slidable for tamping a tobacco charge in said tobacco chamber therefrom through said second open end in such a manner as to locate and shape the charge of tobacco properly relative to such paper to form a cigarette.

7. The cigarette maker of claim 6, further comprising a tongue member attached to said one end of said mandrel means, for aiding in moving a charge of tobacco from said chamber through said second open end of said chamber.

8. The cigarette maker of claim 7, wherein said tongue member is slidably attached to said mandrel means.

9. The cigarette maker of claim 6, further comprising stop means for holding a paper tube in position adjacent said second open end of said tobacco chamber for receiving a charge of tobacco therefrom.

10. The cigarette maker of claim 9, wherein said stop means is longitudinally retractable to make said cigarette maker compact for storage in a pocket.

11. The cigarette maker of claim 10, wherein said stop means comprises a stop plate movable into a position opposing said second open end of said tobacco chamber for engaging such paper tube, a rod secured to said plate, and sleeve means secured to said tobacco chamber and slidably receiving said rod for retraction of said rod and said plate.

12. The cigarette maker of claim 6, wherein said mandrel means is separable from said tobacco chamber.

13. The cigarette maker of claim 6, wherein said mandrel means is slidably but undetachably connected to said means defining said tobacco chamber.

14. The cigarette maker of claim 6, further comprising a pocket clip for securing said cigarette maker in a pocket.

15. The cigarette maker of claim 6, wherein said means defining said tobacco chamber includes flap door means for closing said additional opening.

16. A pocket-sized roll-your-own cigarette maker comprising means defining a tobacco chamber for receiving a charge of tobacco for one cigarette, said means defining said chamber including a lower tongue member having a concave portion; and mandrel means for receiving paper therearound for forming a paper tube for a cigarette, said mandrel means comprising an upper tongue member having a concave portion; said upper tongue member being receivable on said lower tongue member to tamp down a charge of tobacco lying on a cigarette wrapper lying on said concave portion of said lower tongue member in said tobacco chamber in such a manner as to locate and shape the charge of tobacco properly relative to such paper to form a cigarette; said upper tongue member having a cylindrical plug at one end and said lower tongue member having a hinged flap at one end for folding over said cylindrical plug of said upper tongue member when said upper tongue member is received on said lower tongue member to tamp down a tobacco charge.

17. The cigarette maker of claim 16, further comprising a pocket clip for securing said cigarette maker in a pocket.

18. A pocket-sized roll-your-own cigarette maker comprising means defining a tobacco chamber for receiving a charge of tobacco for one cigarette, said means defining said chamber comprising a resilient cylinder having a longitudinal slit permitting said cylinder to be opened against its resilience for inserting tobacco via said slit, and mandrel means for receiving paper therearound for forming a paper tube for a cigarette; said mandrel means including tamper means for tamping a charge of tobacco in said tobacco chamber in such a manner as to locate and shape the charge of tobacco properly relative to such paper to form a cigarette.

19. The cigarette maker of claim 18, further comprising a pocket clip for securing said cigarette maker in a pocket.

* * * * *